US012173457B2

(12) United States Patent
Schröder

(10) Patent No.: US 12,173,457 B2
(45) Date of Patent: Dec. 24, 2024

(54) COBBLESTONE WITH PERIPHERAL STRUCTURING AND A PAVEMENT LAID THEREWITH

(71) Applicant: Detlef Schröder, Aachen (DE)

(72) Inventor: Detlef Schröder, Aachen (DE)

( * ) Notice: Subject to any disclaimer, the term of this patent is extended or adjusted under 35 U.S.C. 154(b) by 715 days.

(21) Appl. No.: 17/423,683

(22) PCT Filed: Dec. 10, 2019

(86) PCT No.: PCT/DE2019/000320

§ 371 (c)(1),
(2) Date: Jul. 16, 2021

(87) PCT Pub. No.: WO2020/147868

PCT Pub. Date: Jul. 23, 2020

(65) Prior Publication Data

US 2022/0120042 A1 Apr. 21, 2022

(30) Foreign Application Priority Data

Jan. 17, 2019 (DE) ..... 10 2019 000 302.0

(51) Int. Cl.
*E01C 5/06* (2006.01)

(52) U.S. Cl.
CPC ..... *E01C 5/06* (2013.01); *E01C 2201/02* (2013.01)

(58) Field of Classification Search
CPC ..... E01C 5/06; E01C 2201/02
See application file for complete search history.

(56) References Cited

U.S. PATENT DOCUMENTS 1,268,123 A * 6/1918 Innes ..... E01C 5/14 404/38
3,464,328 A * 9/1969 Van Der Meijden ..... E01C 5/00 404/41
4,627,764 A * 12/1986 Scheiwiller ..... B28B 7/0064 404/39
D442,703 S * 5/2001 Fifield ..... D25/113
D464,147 S * 10/2002 Van Cauwenbergh ..... D25/113
6,843,461 B2 * 1/2005 Braungardt ..... B28B 7/303 249/176
9,315,950 B2 * 4/2016 Browning ..... E01C 5/065
2004/0120763 A1 * 6/2004 Van Cauwenbergh ... E01C 5/06 404/34
2008/0101860 A1 * 5/2008 Scheiwiller ..... E01C 5/00 404/42

(Continued)

FOREIGN PATENT DOCUMENTS

EP 0221564 A2 11/1986

OTHER PUBLICATIONS

PCT/DE2019/000320, filed Dec. 10, 2019, Written Opinion, mailing date May 27, 2020 (5 pages).

(Continued)

*Primary Examiner* — Abigail A Risic
(74) *Attorney, Agent, or Firm* — Barclay Damon LLP

(57) ABSTRACT

A cobblestone comprises a bottom side, a top side, and at least one side surface substantially perpendicular to the top side and the bottom side. The at least one side surface defines a plurality of surface features. The plurality of surface features comprise alternating projecting portions and receding portions.

10 Claims, 3 Drawing Sheets

(56) References Cited

U.S. PATENT DOCUMENTS

| | | | | |
|---|---|---|---|---|
| 2009/0155497 | A1* | 6/2009 | Castonguay | B44F 5/00 428/15 |
| 2014/0112715 | A1* | 4/2014 | Browning | E01C 5/06 404/41 |
| 2016/0097168 | A1* | 4/2016 | Karau | E01C 5/00 404/38 |
| 2017/0114504 | A1* | 4/2017 | Karau | E01C 5/06 |
| 2021/0262174 | A1* | 8/2021 | Schroeder | E01C 5/00 |

OTHER PUBLICATIONS

PCT/DE2019/000320, filed Dec. 10, 2019, International Search Report, mailing date May 27, 2020 (4 pages).
PCT/DE2019/000320, filed Dec. 10, 2019, English Translation of International Search Report, mailing date May 27, 2020 (2 pages).

* cited by examiner

COBBLESTONE WITH PERIPHERAL STRUCTURING AND A PAVEMENT LAID THEREWITH

CROSS REFERENCE TO RELATED INVENTION

This application is a national stage application pursuant to 35 U.S.C. § 371 of International Application No. PCT/DE2019/000320, filed Dec. 10, 2019, which claims priority to, and benefit of, German Patent Application No. 10 2019 000 302.0, filed Jan. 17, 2019, the entire contents of which are hereby incorporated by reference.

FIELD OF TECHNOLOGY

The present invention relates to a cobblestone with any desired shape having a bottom side, a top side, and a side surface substantially perpendicular thereto, or a plurality of substantially perpendicular side surfaces.

BACKGROUND

Cobblestones are for example made of concrete and mainly have regular shapes. The cobblestones can for example be such that are designed square or rectangular in a horizontal cross-section. However, there also are cobblestones that possess irregular shapes and for example have curved side surfaces. In this regard, a cobblestone that has a circular horizontal cross-section possesses a single curved side surface, whereas cobblestones with regular angular shapes have a plurality of side surfaces.

It is known to provide the side surfaces of such cobblestones with interconnecting sections that enter into engagement like a rack when laying a pavement with interconnecting sections of adjacent stones. A displacement safeguard is thereby achieved against arising horizontal forces. On the other hand, providing a sufficient joint space is desirable to achieve a certain amount of flexibility with the laid pavement and corresponding seepage of surface water.

It is known to equip the side surfaces of such cobblestones with individual interconnecting regions arranged at a distance from each other that, for example, consist of two adjacent projecting interconnecting sections. When creating a pavement, the interconnecting regions of adjacent stones enter into engagement with each other. Of course, only stones can be adjacently positioned in this case that are configured with such an interconnecting system in mind, i.e., that have correspondingly designed interconnecting regions at certain points on their side surfaces. However, especially with cobblestones having irregularly designed side surfaces such as curved side surfaces, difficulties arise in designing such an interconnecting system to allow the creation of a pavement with the desired interconnecting effect.

BRIEF SUMMARY OF THE INVENTION

The object of the present invention is to provide a cobblestone of the above-described type that can be used in a highly universal manner and can easily be laid. This object is achieved according to the invention with a cobblestone of the indicated type in that the side surface or the side surfaces are provided with a peripheral structuring that is arranged in a pattern and configured to meander and consists of projecting and receding sections.

First of all, the cobblestone configured according to the invention is distinguished from the prior art in that its side surface or side surfaces are provided with a peripheral structuring.

In an embodiment, this structuring is formed by a meandering system comprising of alternatingly arranged projecting and receding sections that are arranged in a certain pattern. The projecting and receding sections of the structuring are therefore evenly distributed over the perimeter of the cobblestone so that any stone shapes that are provided with such a structuring, preferably in the same pattern, can be combined into a pavement. In this case, the projecting sections of the one stone engage in the receding sections of the other stone.

In an embodiment, the projecting and receding sections of the formed structuring are preferably configured in the form of vertical strips, wherein they can extend over the entire height of the cobblestone, or only over a part of the height thereof. Accordingly, an embodiment is preferred in which the structuring only extends over the bottom part of the cobblestone.

In an embodiment, the structuring preferably possesses a wavy shape so that alternating wave crests and wave troughs are formed. Other meandering shapes that for example possess angular projections and recesses are also possible, wherein it is important in this case for the individual projecting and receding sections of the structuring to extend around the entire perimeter of the stone in a fixed, even pattern so that any desired placement options exist. When "meandering" or "wavy shape" are mentioned here, these terms refer to a horizontal section of the cobblestone. Three-dimensionally, these are projecting strips or crests and receding troughs.

Depending on the height of the provided structuring, adjacent stones are configured to engage with each other over a certain region of their side surfaces in the laid payment. If only a limited engagement is desired in this case in order to largely ensure the flexibility of the laid pavement, the structuring provided according to the invention can for example only be formed in the bottom region of the cobblestone. However, an embodiment can also be realized in which the cobblestone has projections in its bottom region that project further than the structuring and a further projecting peripheral strip. Therefore, when laying pavement, only the projections or the peripheral strip engages with correspondingly designed elements of adjacent stones so that mutual stone contact is restricted. The provided structuring in this case can be kept in the region of the side surface of the stone thereabove in order to maintain a corresponding interconnecting effect in the joint without direct stone contact.

If a peripheral strip is provided, this further projecting strip therefore preferably possesses a structuring that corresponds to the structuring in the top part of the stone. The advantages of the structuring provided according to the invention are therefore achieved in this embodiment with the peripheral, further projecting strip (spacing strip), wherein at the same time, only relatively slight contact between the laid stones in the pavement is realized. The structuring in the top part of the stone therefore preferably continues identically in the region of the spacing strip, wherein the spacing strip only projects further than the remaining part of the side surface of the stone, and a step is formed between the spacing strip and top structuring.

In a particular embodiment, the cobblestone comprises a base provided with the structuring and at least one stone head arranged on the base. Any number of stone heads can be provided that are separated from each other by dummy joints. The structuring provided according to the invention is restricted in this case to the stone base, wherein the structuring can for example extend over the entire height of the stone base. In this case as well, a peripheral spacing strip provided with a corresponding structuring can be provided in the bottom region of the stone base, or corresponding projections can be arranged that restrict stone contact.

In another preferred embodiment, the meander is formed asymmetrically by laterally offsetting the meander peak relative to the midline of the meander pattern. By means of a special configuration of the structuring, this configuration ensures that, when the cobblestones are adjacently positioned, only a linear, or respectively point contact of stone to stone arises. This is achieved by an asymmetrical configuration of the meander, wherein by laterally offsetting the meander peak, such as a wave crest, relative to the midline of the meander pattern, this minimum contact is achieved when adjacently positioning the stones. In so doing, for example the wave flanks of adjacent stones only lie linearly against each other when assembling the stones since the left and right wave flanks are configured differently, which leads to the mentioned lateral shift of the wave peak.

For example, with a wavy structuring on the corresponding wave flank, there is only a single contact line when adjacently positioning the stones. A keyed, surface contact is therefore avoided in this embodiment. In this context, one therefore speaks of a "distorted meander line" that results from the mentioned asymmetrical meander.

In addition, it is also noted that the expression "peripheral structuring" used here also refers to instances in which slight gaps are provided in the peripheral arrangement that do not impair the concept according to the invention of adjacently placing any desired stone shapes. This is for example the case if a few projecting sections are missing.

The present invention further relates to pavement composed of cobblestones of the type described above.

BRIEF DESCRIPTION OF THE DRAWINGS

The invention will be explained in detail below with reference to exemplary embodiments in conjunction with the drawing. In the figures.

DETAILED DESCRIPTION OF THE INVENTION

Figure 1:
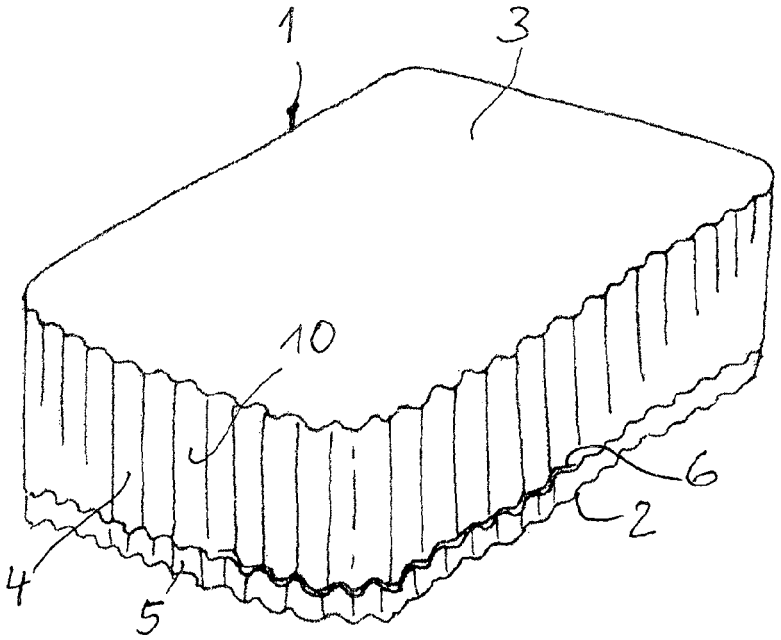
FIG. 1 illustrates a perspective view of an embodiment of a cobblestone.

FIG. 1 shows a cobblestone 1 of concrete that has been produced in a suitable shape. The cobblestone 1 has a rectangular shape in a horizontal cross-section and possesses a bottom side 2, a top side 3 which both are configured substantially flat, and four side surfaces 4. The four side surfaces 4 are provided with a structuring 10, such as surface features, arranged peripherally in a pattern and configured meanderingly and consisting of projecting and receding sections. The structuring is configured to be wavy so that wave crests and wave troughs alternatingly result. The wave crests correspond to projecting strips, and the wave troughs correspond to receding troughs arranged therebetween. As shown, the structuring 10 is arranged peripherally on all side surfaces 4 of the cobblestone.

In the bottom region, the side surfaces 4 are provided with a peripheral spacing strip 5 that also has a structuring which corresponds to the structuring 10, but which projects further than it from the side surface 4. The spacing strip 5 transitions via a step 6 into the top part of the side surfaces 4 that have the structuring 10.

When corresponding cobblestones are adjacently positioned to form a pavement, only the structured spacing strip 5 enters into contact with corresponding spacing strips of adjacent stones. In so doing, the projecting sections of the structuring of the spacing strip S penetrate more or less into the receding sections of the adjacent stones and vice versa. A displacement safeguard between the cobblestones is thereby achieved. In the top region, i.e., above the spacing strip 5, a joint arises that is filled with corresponding joint material. Since there is a wavy structuring 10 here as well, a corresponding displacement safeguard is also achieved in this region in conjunction with the associated joint material.

Since the bottom spacing strip 5 of the cobblestone 1 is provided with a peripheral wavy structuring that is arranged in a certain pattern, such cobblestones can be assembled substantially independent of their shape into a pavement with other cobblestones of any other desired shape. Accordingly, for example, cobblestones with regular shapes can be combined with cobble-stones with irregular shapes (round, angular, etc.), wherein a plurality of projecting and receding sections are available for adjacently placing the stones. The same pattern does not even have to be maintained by all the stones; instead, given the many projecting and receding sections, other pattern dimensions can be used, and the stones can nonetheless be adjacently positioned in an interconnection.

Figure 2:
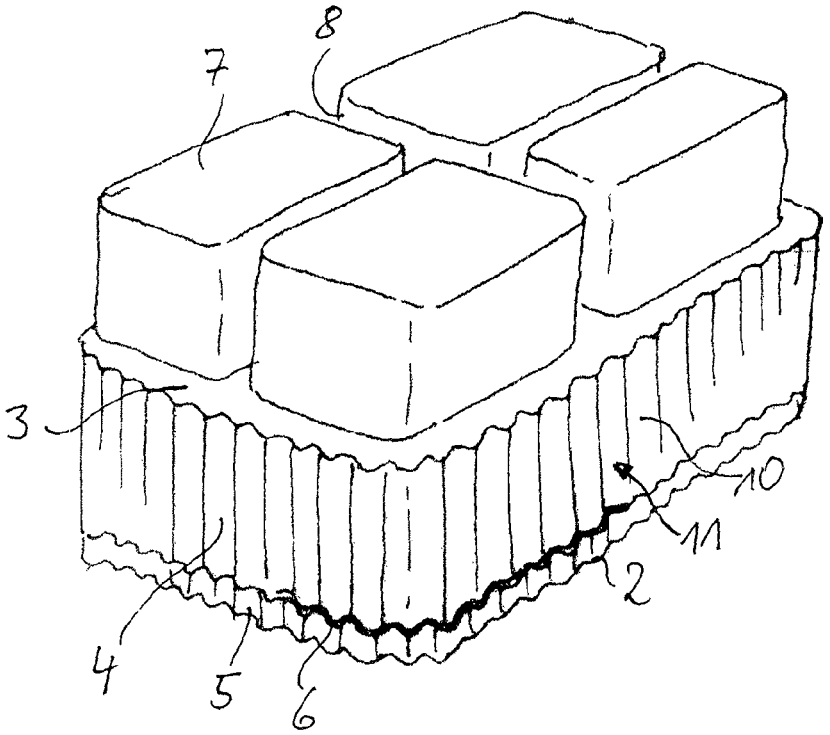
FIG. 2 illustrates a perspective view of another embodiment of a cobblestone.

FIG. 2 shows a spatial view of an embodiment of a cobblestone that has a bottom base 11 with a flat bottom side 2 and a flat top side 3 on which four stone heads 7 are arranged that are separated from each other by joints 8. In this case, the base 11 of the cobblestone possesses a corresponding structuring like the embodiment of the cobblestone 1 shown in FIG. 1. When two stones are in an adjacently positioned state, basically three regions need to be considered: In the bottom region of the spacing strips 5, the adjacent stones are in contact with each other; in the region thereabove of the side surfaces that have the structuring 10, a joint is formed between the adjacent stones, and in the top region of the stone heads 7, a comparatively wider joint arises. Apart from the stone heads 7, this cobblestone has the same features as the embodiment of the cobblestone 1 in FIG. 1.

Figure 3:
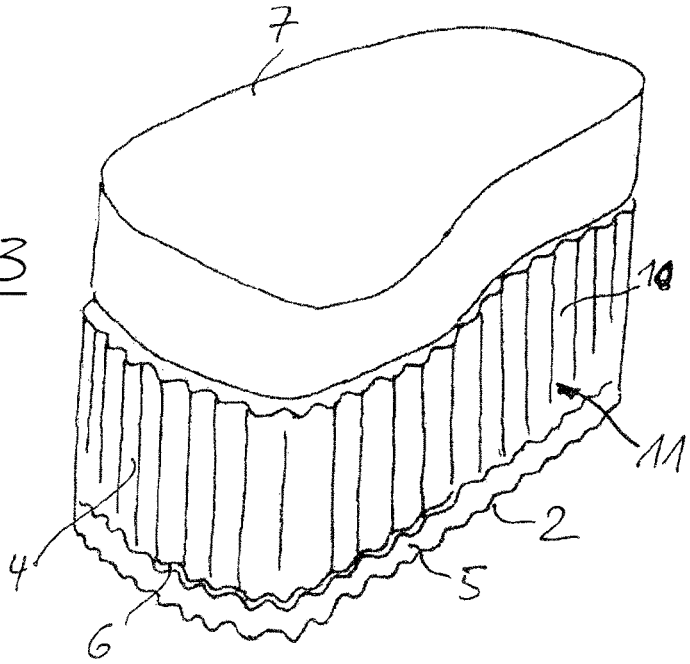
FIG. 3 illustrates a perspective view of another embodiment of a cobblestone.
Figure 4:
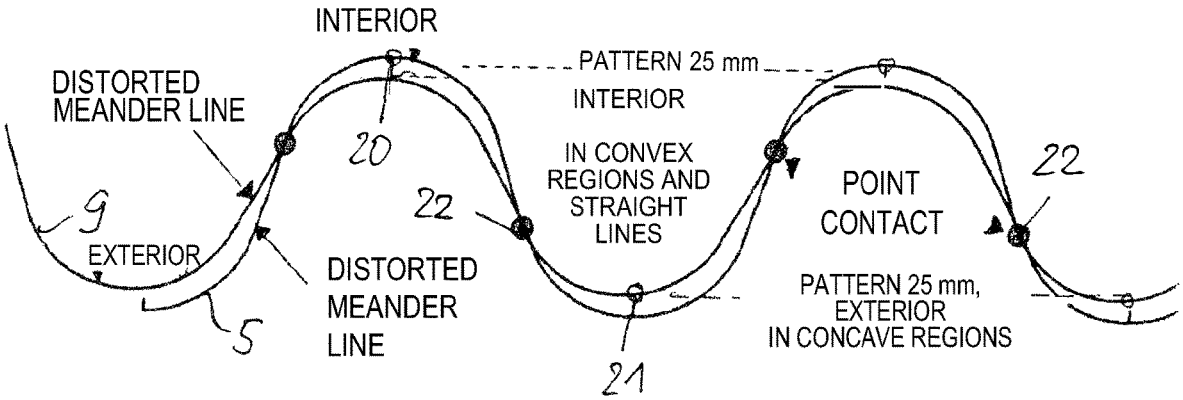
FIG. 4 illustrates a schematic representation of an embodiment of meandering lines of the side surface of adjacently positioned cobblestones.
Figure 4:
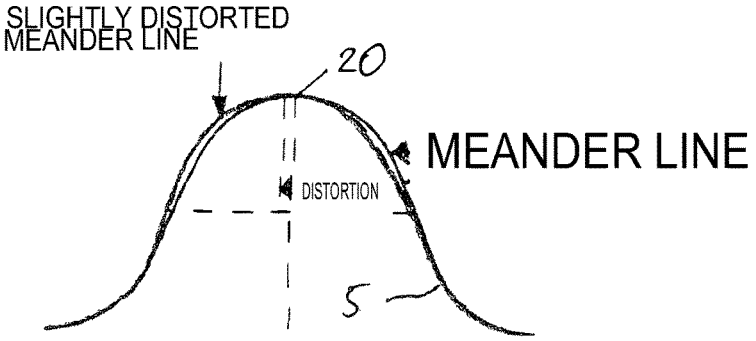

FIG. 3 shows an embodiment of the cobblestone that has a corresponding base 11 like the stone in FIG. 2, but only possesses a single stone head 7 on the base 11. The base is correspondingly designed like the one of the cobblestone in FIG. 2. As already mentioned above, when several cobblestones are adjacently positioned, they are in contact with each other via the provided spacing strips 5. To prevent an extensive, or respectively keyed contact between the spacing strips 5 from resulting, the meander of the particular spacing strips is configured asymmetrically, wherein the corresponding meander peak 20 is laterally offset in this case from the midline 21 of the meander pattern. FIG. 4 shows the corresponding meander lines of a spacing strip 5 of a first stone and a spacing strip 9 of a second stone. The wave peak 20 of the corresponding wavily structured spacing strip is laterally offset in this case from the midline 21 of the meander pattern so that asymmetrical conditions result. Given the adjacent positioning of the spacing strips of two stones, the spacing strips are then not against each other in an extensive or keyed contact; instead, there are only individual contact lines 22 between the spacing strips, wherein such a linear contact line 22 is arranged on each wave flank. In the depiction in FIG. 4, this is identified as a point contact 22. In the bottom depiction in FIG. 4, such a "distorted meander line" is depicted in comparison to a symmetrically configured meander line, wherein in this case, the lateral offset of the meander peak 20 is drawn.

Figure 5:
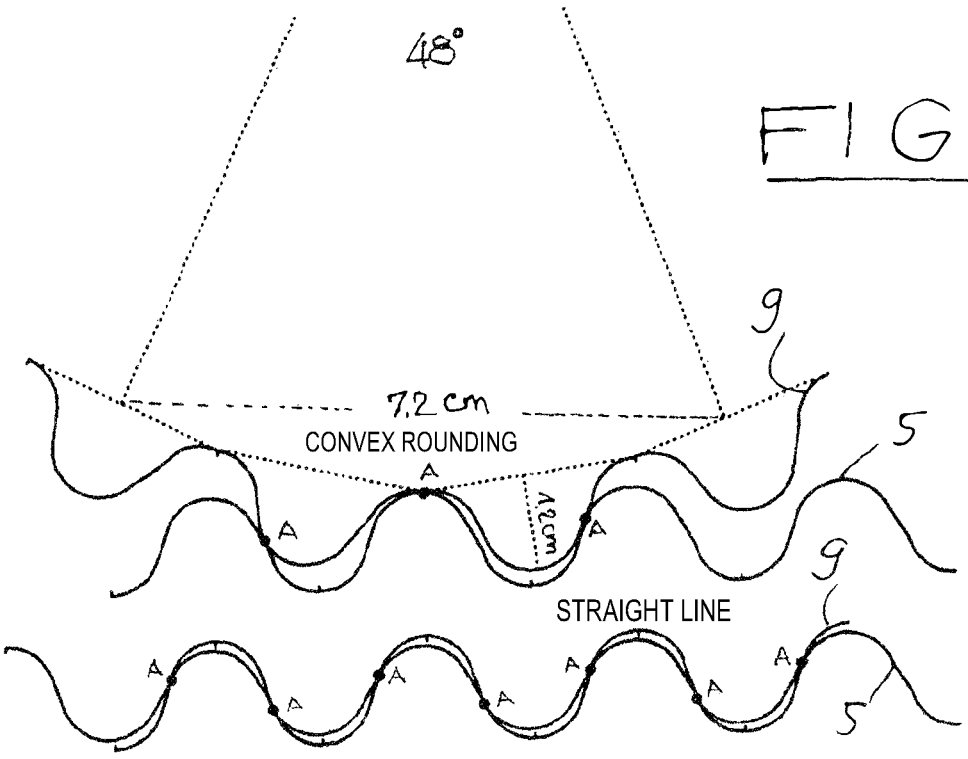
FIG. 5 illustrates a schematic representation of another embodiment of meander lines of adjacently positioned stones.

FIG. 5 shows the meander lines 5, 9 of two adjacently positioned cobblestones, wherein in the top representation, a round, top stone contacts a flat, bottom stone. In the bottom representation, two stones with flat side surfaces are adjacently positioned. It can be seen that, in both cases, only a linear contact arises that is shown at "A".

The invention claimed is:

1. A cobblestone comprising:

a bottom side;

a top side; and at least one side surface substantially perpendicular to the top side and the bottom side, wherein the at least one side surface defines a plurality of surface features, wherein the plurality of surface features comprise alternating projecting portions and receding portions forming a meander pattern comprising meander peaks and meander midlines, wherein the meander pattern is formed asymmetrically by means of a lateral offset of meander peaks relative to a midline of the meander pattern.

2. The cobblestone according to claim 1, wherein the plurality of surface features extend over a portion of a height of the at least one side surface.

3. The cobblestone according to claim 1, wherein the plurality of surface features comprise a wavy configuration.

4. The cobblestone according to claim 1, wherein the at least one side surface comprises a top region and a bottom region, wherein the bottom region comprises a projecting strip configured to project farther from the at least one side surface than the top region, and wherein the top region and the projecting strip of the bottom region include the surface features.

5. The cobblestone according to claim 4, wherein the projecting strip comprises a plurality of surface features that correspond to the plurality of surface features of the top region of the at least one side surface.

6. The cobblestone according to claim 1, further comprising a base defining a plurality of surface features and at least one stone head arranged on the base.

7. The cobblestone of claim 1, wherein the projecting portions comprise wave flanks arranged to a left and to a right of each meander peak, wherein the left and right wave flanks are configured differently.

8. A pavement comprised of a plurality of cobblestones arranged adjacent to each other, wherein each of the plurality of cobblestones comprises:

a bottom side;

a top side; and at least one side surface substantially perpendicular to the top side and the bottom side, wherein the at least one side surface comprises, a top region, and a bottom region configured to protrude from the at least one side surface farther than the top region, wherein the top region and the bottom region defines a plurality of surface features structured to inhibit displacement between one of the plurality of cobblestones relative to an adjacent one of the plurality of cobblestones, wherein the plurality of surface features comprise alternating projecting portions and receding portions.

9. A cobblestone comprising:

a bottom side;

a top side; and at least one side surface substantially perpendicular to the top side and the bottom side, wherein the at least one side surface defines a plurality of surface features, wherein the plurality of surface features comprise alternating projecting portions and receding portions, wherein the at least one side surface comprises a top region and a bottom region, wherein a step is formed between the top region and the bottom region, wherein the top region is provided with the plurality of surface features, and wherein the bottom region comprises a projecting strip configured to project farther from the at least one side surface than the top region and the projecting strip comprises a plurality of surface features that correspond to the plurality of surface features of the top region of the at least one side surface.

10. The pavement comprised of cobblestones according to claim 8, wherein the surface features of each of the plurality of cobblestones comprise a meander pattern comprising meander peaks and meander midlines, wherein the meander pattern is formed asymmetrically by means of a lateral offset of meander peaks relative to a midline of the meander pattern.

* * * * *